US011842687B1

(12) United States Patent
Fan et al.

(10) Patent No.: US 11,842,687 B1
(45) Date of Patent: Dec. 12, 2023

(54) PIXEL DRIVING CIRCUIT, PIXEL DRIVING METHOD AND DISPLAY DEVICE

(71) Applicant: HKC CORPORATION LIMITED, Shenzhen (CN)

(72) Inventors: Tao Fan, Shenzhen (CN); Baohong Kang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/330,059

(22) Filed: Jun. 6, 2023

(30) Foreign Application Priority Data

Sep. 11, 2022 (CN) ..... 202211398611.7

(51) Int. Cl.
*G09G 3/3233* (2016.01)

(52) U.S. Cl.
CPC ... *G09G 3/3233* (2013.01); *G09G 2300/0842* (2013.01); *G09G 2310/0267* (2013.01); *G09G 2320/0233* (2013.01)

(58) Field of Classification Search
CPC ..... G09G 3/3233; G09G 2300/0842; G09G 2310/0267; G09G 2320/0233
See application file for complete search history.

(56) References Cited

U.S. PATENT DOCUMENTS

| | | | | |
|---|---|---|---|---|
| 8,917,225 | B2 | 12/2014 | Kang et al. | |
| 11,741,884 | B2 * | 8/2023 | Kim | G09G 3/325 345/55 |
| 2011/0164018 | A1 | 7/2011 | Kang et al. | |
| 2020/0184886 | A1 * | 6/2020 | Chun | G09G 3/3291 |
| 2021/0201759 | A1 | 7/2021 | Cho et al. | |

FOREIGN PATENT DOCUMENTS

| | | |
|---|---|---|
| CN | 102842283 | 12/2012 |
| CN | 110164378 | 8/2019 |
| CN | 110223639 | 9/2019 |
| CN | 113223458 | 8/2021 |
| CN | 113487996 | 10/2021 |
| CN | 114822413 | 7/2022 |
| CN | 115035854 | 9/2022 |
| WO | 2016146053 | 9/2016 |
| WO | 2019237472 | 12/2019 |

OTHER PUBLICATIONS

CNIPA, Notification to Grant Patent Right for Invention for CN Application No. 202211398611.7, Dec. 15, 2022.

* cited by examiner

*Primary Examiner* — Jeff Piziali
(74) *Attorney, Agent, or Firm* — Hodgson Russ LLP

(57) ABSTRACT

A pixel driving circuit includes a light-emitting component, a driving transistor, a storage capacitor, a compensation capacitor, and first to third control assemblys. A control terminal, a first terminal and a second terminal of the driving transistor are correspondingly connected to a point G, a point S and a point D. A first response terminal, a receiving terminal and an output terminal of the first control assembly are correspondingly connected to a first control line, a power line and the point S. A second response terminal, a ground terminal, a data signal terminal and first to third connection terminals of the second control assembly are correspondingly connected to a scan line, a ground line, a data line, the point G, a point Q and a first terminal of the storage capacitor. A second terminal of the storage capacitor is connected to the point S.

19 Claims, 4 Drawing Sheets

PIXEL DRIVING CIRCUIT, PIXEL DRIVING METHOD AND DISPLAY DEVICE

CROSS-REFERENCE TO RELATED APPLICATIONS

This application claims priority to Chinese Patent Application No. 202211398611.7, filed Nov. 9, 2022, the entire contents of which are incorporated herein by reference.

TECHNICAL FIELD

The present disclosure relates to the technical field of display, and more particularly, to a pixel driving circuit, a pixel driving method and a display device.

BACKGROUND

At present, a low temperature poly-silicon (LTPS) or oxide thin film transistor (TFT) driving technique is often used in an organic light-emitting diode (OLED) display. Generally, the brightness of an OLED mainly depends on the magnitude of a driving current thereof. The heavier the current, the higher the brightness. A threshold voltage for driving a TFT and a change in carrier mobility are both important factors influencing an OLED driving current. LTPS and oxide TFT devices may change in threshold voltage and carrier mobility thereof as they age over time, which will have influence on the display effect of the OLED and even result in poor display such as reduced contrast, residual image and flickering.

SUMMARY

There are provided a pixel driving circuit, a pixel driving method and a display device according to embodiments of this disclosure. The technical solution is as below:

According to a first aspect of the present disclosure, there is provided a pixel driving circuit, including a light-emitting component, and a driving transistor having a control terminal connected to a point G, a first terminal connected to a point S, and a second terminal connected to a point D. The pixel driving circuit further includes a storage capacitor, a compensation capacitor, a first control assembly, a second control assembly, and a third control assembly. The first control assembly has a first response terminal connected to a first control line, a receiving terminal connected to a power line, and an output terminal connected to the point S; the first response terminal is configured to control an on-off state between the receiving terminal and the output terminal in response to a level signal provided by the first control line. The second control assembly has a second response terminal connected to a scan line, a ground terminal connected to a ground line, a data signal terminal connected to a data line, a first connection terminal connected to the point G, a second connection terminal connected to a point Q, and a third connection terminal connected to a first terminal of the storage capacitor; the second response terminal is configured to control on-off states between the receiving terminal, the data signal terminal, the first connection terminal, the second connection terminal and the third connection terminal in response to level signals provided by the scan line. A second terminal of the storage capacitor is connected to the point S. The third control assembly has a third response terminal connected to a second control line, a fourth connection terminal connected to the point Q, a fifth connection terminal connected to the point D, and a sixth connection terminal connected to a positive electrode of the light-emitting component; and the third response terminal is configured to control on-off states between the fourth connection terminal, the fifth connection terminal and the sixth connection terminal in response to level signals provided by the second control line. A negative electrode of the light-emitting component is connected to the ground line; and a first terminal of the compensation capacitor is connected to the point G, while a second terminal of the compensation capacitor is connected to the point Q.

According to a second aspect of the present disclosure, there is provided a pixel driving method for driving the pixel driving circuit described above. The pixel driving method includes: a reset stage, a threshold voltage compensation stage, a mobility compensation stage and a light-emitting display stage.

At the reset stage: a first level signal is provided to the first response terminal by the first control line such that the receiving terminal and the output terminal of the first control assembly are switched on; a second level signal is provided to the second response terminal by the scan line such that the ground terminal and the third connection terminal of the second control terminal are switched on, the first connection terminal and the third connection terminal are switched off, the data signal terminal and the first connection terminal are switched on, and the first connection terminal and the second connection terminal are switched on; and a third level signal is provided to the third response terminal by the second control line such that the fourth connection terminal and the fifth connection terminal of the third control assembly are switched off, and the fifth connection terminal and the sixth connection terminal are switched on.

At the threshold voltage compensation stage: a fourth level signal is provided to the first response terminal by the first control line such that the receiving terminal and the output terminal of the first control assembly are switched off; a fifth level signal is provided to the second response terminal by the scan line such that the ground terminal and the third connection terminal of the second control terminal are switched on, the first connection terminal and the third connection terminal are switched off, the data signal terminal and the first connection terminal are switched on, and the first connection terminal and the second connection terminal are switched on; and a sixth level signal is provided to the third response terminal by the second control line such that the fourth connection terminal and the fifth connection terminal of the third control assembly are switched off, and the fifth connection terminal and the sixth connection terminal are switched on.

At the mobility compensation stage: a seventh level signal is provided to the first response terminal by the first control line such that the receiving terminal and the output terminal of the first control assembly are switched on; an eighth level signal is provided to the second response terminal by the scan line such that the ground terminal and the third connection terminal of the second control terminal are switched off, the first connection terminal and the third connection terminal are switched on, the data signal terminal and the first connection terminal are switched off, and the first connection terminal and the second connection terminal are switched off; and a ninth level signal is provided to the third response terminal by the second control line such that the fourth connection terminal and the fifth connection terminal of the third control assembly are switched on, and the fifth connection terminal and the sixth connection terminal are switched off.

At the light-emitting display stage: a tenth level signal is provided to the first response terminal by the first control line such that the receiving terminal and the output terminal of the first control assembly are switched on; an eleventh level signal is provided to the second response terminal by the scan line such that the ground terminal and the third connection terminal of the second control terminal are switched off, the first connection terminal and the third connection terminal are switched on, the data signal terminal and the first connection terminal are switched off, and the first connection terminal and the second connection terminal are switched off; and a twelfth level signal is provided to the third response terminal by the second control line such that the fourth connection terminal and the fifth connection terminal of the third control assembly are switched off, and the fifth connection terminal and the sixth connection terminal are switched on.

According to a third aspect of the present disclosure, there is provided a display device including a display panel and a controller, wherein the display panel has the pixel driving circuit as described in any one above, and the controller is configured to carry out the pixel driving method as described in any one above. It should be understood that the above general description and the following detailed description are merely exemplary and explanatory, and should not be construed as limitations to the present disclosure.

BRIEF DESCRIPTION OF THE DRAWINGS

The accompanying drawings, which are hereby incorporated in and constitute a part of the present description, illustrate embodiments of the present disclosure, and together with the description, serve to explain the principles of the present disclosure. Apparently, the accompanying drawings in the following description show merely some embodiments of the present disclosure, and other drawings may be derived from these drawings by a person of ordinary skill in the art without creative efforts.

DETAILED DESCRIPTION OF THE EMBODIMENTS

The exemplary embodiments are described fully below with reference to the accompanying drawings. However, the exemplary embodiments may be implemented in various forms, and should not be construed as being limited to embodiments described herein. On the contrary, these exemplary embodiments are provided to make the present disclosure more comprehensive and complete and to fully convey the concept of the exemplary embodiments to those skilled in the art.

Moreover, the terms "first" and "second" are merely used for the purpose of description and should not be construed as indicating or implying relative importance, or implicitly indicating the number of technical features indicated. Thus, features defined with "first" and "second" may explicitly or implicitly include one or more of the features. In the description of the present disclosure, "a plurality of" means two or more, unless otherwise specifically defined.

Furthermore, the described features, structures or characteristic may be combined in one or more embodiments in any suitable manner. Many specific details are provided in the following description to provide a fully understanding of the embodiments of the present disclosure. However, a person skilled in the art will recognize that the technical solutions of the present disclosure may be practiced without one or more of specific details, or other methods, components, devices, steps and the like may be adopted. In other cases, well-known methods, devices, implementations or operations will not be illustrated or described in detail to avoid obscuring various aspects of the present disclosure.

Embodiment 1

Figure 1:
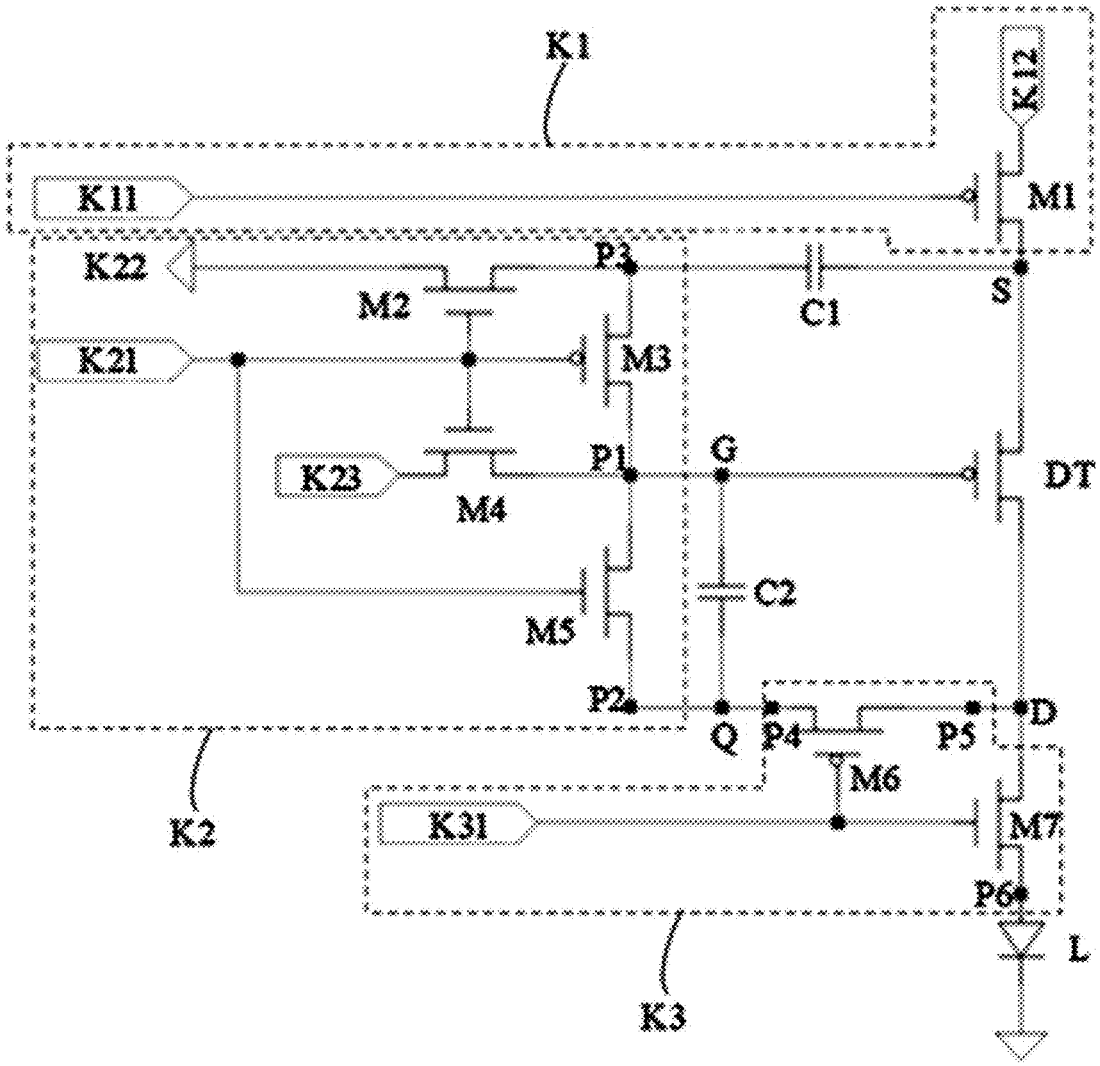
FIG. 1 shows a schematic diagram of a pixel driving circuit according to embodiment 1 of the present disclosure.

This embodiment of the present disclosure provides a pixel driving circuit. With reference to FIG. 1, the pixel driving circuit of the present disclosure may include a light-emitting component L, a driving transistor DT, a storage capacitor C1, a compensation capacitor C2, a first control assembly K1, a second control assembly K2 and a third control assembly K3. Connections between these components will be set forth in detail below.

The light-emitting component L may be a current-driven light-emitting component, and is controlled by a current flowing through the driving transistor DT to emit light. For example, the light-emitting component L may be an organic light-emitting diode (OLED). In other words, the pixel driving circuit may be applied to an OLED display product, and may be particularly applied to an active-matrix OLED (AMOLED) product for the advantages of AMOLED, such as self-illumination, low power consumption, wide viewing angle, high gamut, high contrast and fast response.

The driving transistor DT has a control terminal connected to a point G, a first terminal connected to a point S, and a second terminal connected to a point D. The control terminal of the driving transistor DT may be configured to control the first terminal and the second terminal of the driving transistor DT to be in an on state or an off state in response to a voltage at the point G, i.e., control the point S and the point D to be switched on or off and allow a current to flow through when the point S and the point D are switched on.

The control terminal of the driving transistor DT in this embodiment may be construed as a gate of the driving transistor DT, and one of the first terminal and the second terminal may be construed as a source of the driving transistor DT, while the other one may be construed as a drain of the driving transistor DT, depending on a type of the specific driving transistor DT and an access situation in a circuit, which will not be defined overmuch here.

For example, the driving transistor DT may be a P-type transistor. That is, the control terminal of the driving transistor DT may place the first terminal and the second terminal thereof in the on state in response to a low-level signal. But it is not limited thereto, the driving transistor DT may also be an N-type transistor. That is, the control terminal of the driving transistor DT may place the first terminal and the second terminal thereof in the on state in response to a high-level signal.

The first control assembly K1 has a first response terminal K11 connected to a first control line, a receiving terminal K12 connected to a power line, and an output terminal connected to the point S (it should be understood that as shown in FIG. 1, the output terminal coincides with the point S). The first response terminal K11 may be configured to control an on-off state between the receiving terminal K12 and the output terminal (point S) in response to a level signal provided by the first control line; and when the receiving terminal K12 and the output terminal (point S) are switched on, a power voltage provided by the power line to the receiving terminal K12 may be written to the point S.

The second control assembly K2 has a second response terminal K21 connected to a scan line, a ground terminal K22 connected to a ground line, a data signal terminal K23 connected to a data line, a first connection terminal P1 connected to the point G, a second connection terminal P2 connected to a point Q, and a third connection terminal P3 connected to a first terminal of the storage capacitor C1, with a second terminal of the storage capacitor C1 being connected to the point S. The second response terminal K21 may be configured to control on-off states between the receiving terminal K22, the data signal terminal K23, the first connection terminal P1, the second connection terminal P2 and the third connection terminal P3 in response to level signals provided by the scan line. Specifically, the second response terminal K21 may be configured to, in response to level signals provided by the scan line, control the ground terminal K22 and the third connection terminal P3 to be in the on or off state, the first connection terminal P1 and the third connection terminal P3 to be in the on or off state, the data signal terminal K23 and the first connection terminal P1 to be in the on or off state, and the first connection terminal P1 and the second connection terminal P2 to be in the on or off state, so as to control states of the storage capacitor C1, the compensation capacitor C2, the driving transistor DT and the light-emitting component L at each stage.

The third control assembly K3 has a third response terminal K31 connected to a second control line, a fourth connection terminal P4 connected to the point Q, a fifth connection terminal P5 connected to the point D, and a sixth connection terminal P6 connected to a positive electrode of the light-emitting component L, with a negative electrode of the light-emitting component being connected to the ground line. The third response terminal K31 may be configured to control on-off states between the fourth connection terminal P4, the fifth connection terminal P5 and the sixth connection terminal P6 in response to level signals provided by the second control line. Specifically, the third response terminal K31 may be configured to, in response to level signals provided by the second control line, control the fourth connection terminal P4 and the fifth connection terminal P5 to be in the on or off state, and the fifth connection terminal P5 and the sixth connection terminal P6 to be in the on or off state, so as to control states of the storage capacitor C1, the compensation capacitor C2, the driving transistor DT and the light-emitting component L at each stage.

A first terminal of the compensation capacitor C2 is connected to the point G, while a second terminal of the compensation capacitor C2 is connected to the point Q.

In this solution, the first control assembly K1, the second control assembly K2 and the third control assembly K3 may achieve a reset stage, a threshold voltage compensation stage, a mobility compensation stage and a light-emitting display stage of the pixel driving circuit in coordination with a control signal provided by the first control line, a control signal provided by the second control line, a scanning signal provided by the scan line, a data signal provided by the data line, a power signal provided by the power line, and a ground signal provided by the ground line, and adverse factors such as a threshold voltage Vth and a power voltage (e.g., a voltage provided by the power line) can be eliminated. However, since a driving current may preferentially charge the compensation capacitor C2 at the mobility compensation stage, a compensation voltage at the compensation capacitor C2 can be derived. Thus, at the light-emitting display stage, a current flowing through the driving transistor DT is irrelevant to the threshold voltage of the driving transistor DT and the power voltage, but relevant to controllable parameter such as a data voltage provided by the data line and a duration of the mobility compensation stage. According to this solution, a compensation degree may be adjusted by adjusting the duration of the mobility compensation stage. In other words, the pixel driving circuit of this solution serves for compensating a threshold voltage Vth drift of the driving transistor DT and the carrier mobility, thereby reducing the influence of the threshold voltage and a leakage current on the driving current, improving the display effect and enhancing the display uniformity.

For example, the first control line, the second control line and the scan line in this embodiment are independent of one another, allowing the first control assembly K1, the second control assembly K2 and the third control to control independent of one another. Thus, the driving difficulty of the pixel driving circuit of this solution can be reduced while the brightness of light emission is guaranteed.

In an alternative embodiment, the first control assembly K1 further has a first transistor M1 having a control terminal connected to the first response terminal K11, a first terminal connected to the receiving terminal K12, and a second terminal connected to the output terminal. It may be construed in another way that the first transistor M1 may be equivalent to the first control assembly K1. That is, the control terminal of the first transistor M1 is equivalent to the first response terminal K11, while the first terminal of the first transistor M1 is equivalent to the receiving terminal K12 and the second terminal of the first transistor M1 is equivalent to the output terminal. Thus, the structure of the first control assembly K1 may be simplified while the control of the on-off state between the receiving terminal K12 and the output terminal (point S) is facilitated. This helps reduce the space occupied by the pixel driving circuit, thereby facilitating the increase of the pixel density of a display product.

It should be understood that the control terminals of the first transistor M1 mentioned in the present disclosure and second to seventh transistors M2-M7 mentioned below may be gates of the driving transistors, and one of the first terminal and the second terminal may be a source of a driving transistor, while the other one may be a drain of a driving transistor, depending on a type of each specific driving transistor and an access situation in a circuit, which will not be defined overmuch here.

For example, the first transistor M1 may be a P-type transistor. That is, the control terminal of the first transistor M1 may place the first terminal and the second terminal thereof in the on state in response to a low-level signal received by the control terminal. Without limitation, the first transistor M1 may also be an N-type transistor.

In an alternative embodiment, the first transistor M1 is disposed adjacent to the driving transistor DT, and a type of the first transistor M1 is the same as that of the driving transistor DT. For example, when the driving transistor DT is a P-type transistor, the first transistor M1 may also be a P-type transistor; alternatively, the driving transistor DT and the first transistor M1 are both N-type transistors to reduce the doping difficulty and increase the product yield.

In an alternative embodiment, the second control assembly K2 further has a second transistor M2, a third transistor M3, a fourth transistor M4 and a fifth transistor M5.

Control terminals of the second transistor M2, the third transistor M3, the fourth transistor M4 and the fifth transistor M5 each are connected to the second response terminal K21. The second transistor M2 has a first terminal connected to the ground terminal K22 and a second terminal connected to the third connection terminal P3. The third transistor M3 has a first terminal connected to the first connection terminal P1 and a second terminal connected to the third connection terminal P3. The fourth transistor M4 has a first terminal connected to the data signal terminal K23 and a second terminal connected to the first connection terminal P1. The fifth transistor M5 has a first terminal connected to the first connection terminal P1 and a second terminal connected to the second connection terminal P2.

The second transistor M2, the fourth transistor M4 and the fifth transistor M5 each are first-type transistors; the third transistor M3 is a second-type transistor; and one of the first-type transistor and the second-type transistor is a P-type transistor, while the other one is an N-type transistor. In other words, at the same stage, when the second transistor M2, the fourth transistor M4 and the fifth transistor M5 are in the on state in response to signals provided by the second response terminal K21, the third transistor M3 is in the off state; alternatively, when the second transistor M2, the fourth transistor M4 and the fifth transistor M5 are in the on state in response to signals provided by the second response terminal K21, the third transistor M3 is in the on state.

The second control assembly K2 in this embodiment is designed with four transistors so that the second response terminal K21, the ground terminal K22, the data signal terminal K23, the first connection terminal P1, the second connection terminal P2 and the third connection terminal P3 thereof can be connected, so as to control the on-off states between the ground terminal K22, the data signal terminal K23, the first connection terminal P1, the second connection terminal P2 and the third connection terminal P3 when the second response terminal K21 responses to the scanning signal provided by the scan line. Thus, when the working state at each stage is achieved in coordination with other control units, the number of control lines can be reduced. For example, the second control assembly K2 only needs one scan line for control so that an aperture ratio of a pixel can be increased.

In a specific embodiment, the third transistor M3 is disposed closer to the driving transistor DT than the second transistor M2, the fourth transistor M4 and the fifth transistor M5. To reduce the doping difficulty, the types of the third transistor M3 and the driving transistor DT may be set to be the same. For example, when the driving transistor DT is a P-type transistor, the third transistor M3 may also be a P-type transistor, and the second transistor M2, the fourth transistor M4 and the fifth transistor M5 each may be N-type transistors. Alternatively, the driving transistor DT and the third transistor M3 may be both N-type transistors, and the second transistor M2, the fourth transistor M4 and the fifth transistor M5 each may be P-type transistors.

In a specific embodiment, the third control assembly K3 further includes a sixth transistor M6 and a seventh transistor M7.

Control terminals of the sixth transistor M6 and the seventh transistor M7 are both connected to the third response terminal K31. The sixth transistor M6 has a first terminal connected to the fourth connection terminal P4 and a second terminal connected to the fifth connection terminal P5. The seventh transistor M7 has a first terminal connected to the fifth connection terminal P5 and a second terminal connected to the sixth connection terminal P6.

One of the sixth transistor M6 and the seventh transistor M7 is a P-type transistor, while the other one is an N-type transistor. In other words, at the same stage, when the sixth transistor M6 is in the on state in response to a signal provided by the third response terminal K31, the seventh transistor M7 is in the off state; alternatively, when the sixth transistor M6 is in the off state in response to a signal provided by the third response terminal K31, the seventh transistor M7 is in the on state.

The third control assembly K3 in this embodiment is designed with two transistors so that the third response terminal K31, the fourth connection terminal P4, the fifth connection terminal P5 and the sixth connection terminal P6 thereof can be connected, so as to control the on-off states between the fourth connection terminal P4, the fifth connection terminal P5 and the sixth connection terminal P6 when the third response terminal K31 responses to the control signal provided by the second control line. Thus, when the working state at each stage is achieved in coordination with other control units, the number of control lines can be reduced. For example, the third control assembly K3 only needs one second control line for control so that an aperture ratio of a pixel can be increased.

In a specific embodiment, the sixth transistor M6 is disposed closer to the driving transistor DT than the seventh transistor M7. To reduce the doping difficulty, the types of the sixth transistor M6 and the driving transistor DT may be set to be the same. For example, when the driving transistor DT is a P-type transistor, the sixth transistor M6 may also be a P-type transistor, and the seventh transistor M7 may be an N-type transistor. Alternatively, the driving transistor DT and the sixth transistor M6 may be both N-type transistors, and the seventh transistor M7 may be a P-type transistor.

Figure 3:
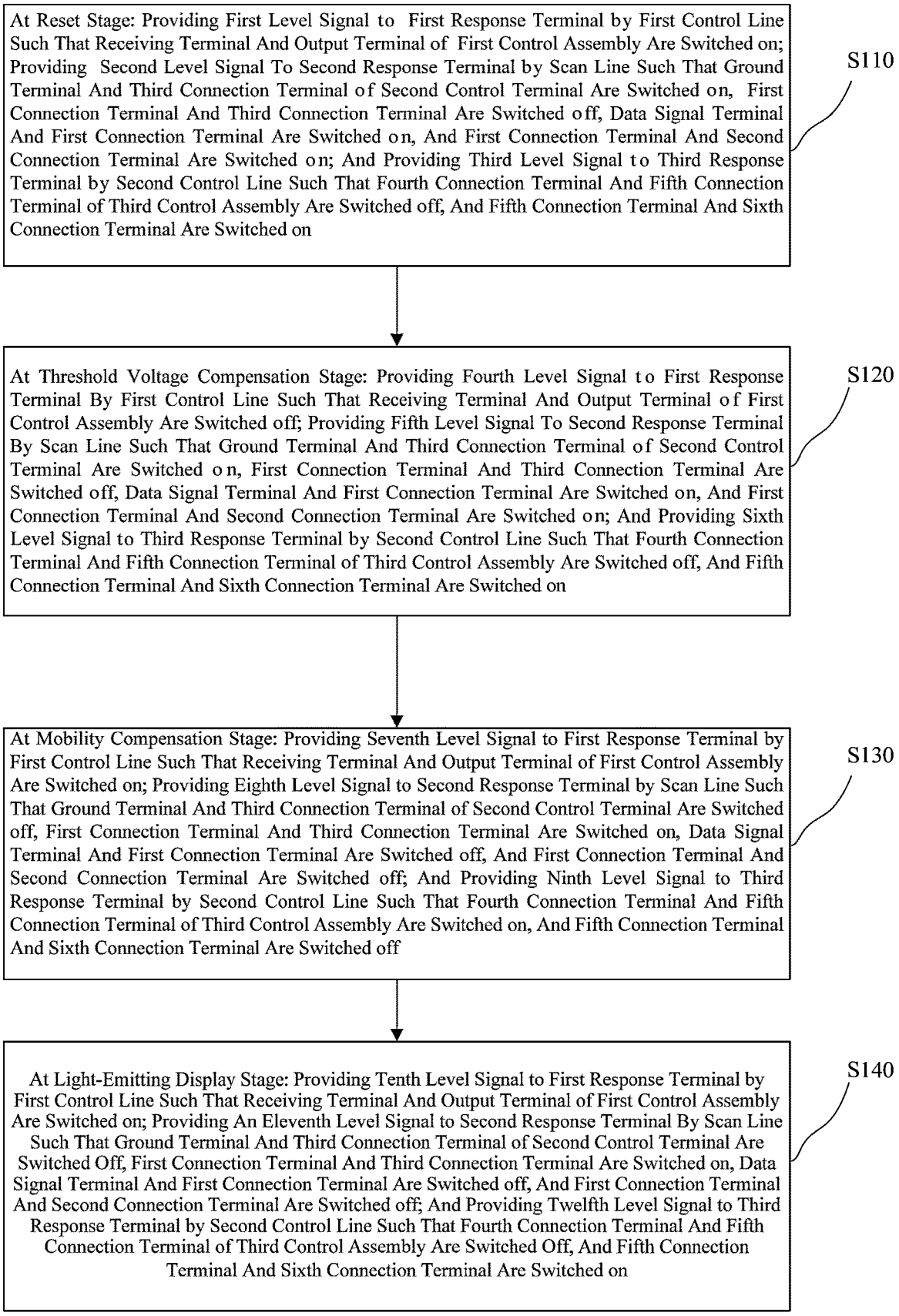
FIG. 3 is a flow chart of a pixel driving method according to the present disclosure.

With reference to the pixel driving circuit shown in FIG. 1, the driving transistor DT, the first transistor M1, the third transistor M3 and the sixth transistor M6 each are P-type transistors, and the second transistor M2, the fourth transistor M4, the fifth transistor M5 and the seventh transistor M7 each are N-type transistors. Without limitation, like the pixel driving circuit, the driving transistor DT, the first transistor M1, the third transistor M3 and the sixth transistor M6 each are N-type transistors, and the second transistor M2, the fourth transistor M4, the fifth transistor M5 and the seventh transistor M7 each are P-type transistors, so long as high and low levels of each signal line in FIG. 3 at each stage are converted, which will not be specifically described here.

For example, the transistors, namely the driving transistor DT and the first to seventh transistors M7, mentioned in this embodiment, each may be LTPS or oxide TFTs to provide good stability and good carrier mobility.

Furthermore, each transistor may be of a bottom gate type. That is, the control terminal of the transistor is located below an active layer (on a side close to a glass substrate) so that the product can be thinned appropriately. Without limitation, each transistor may also be of a top gate type, depending on the specific circumstances.

Each transistor may be an enhanced transistor or a depleted transistor, which will not be specifically defined in the embodiment of the present disclosure.

On this basis, the pixel driving circuit of the embodiment of the present disclosure uses an 8T2C (8 transistors and 2 capacitors) structure to realize the reset stage, the threshold voltage compensation stage, the mobility compensation stage and the light-emitting display stage. With such a design, the compensation degree may be adjusted by adjusting the duration of the mobility compensation stage while the influence of factors such as the threshold voltage Vth, OLED aging and a difference in power signal VDD on display is eliminated. Thus, the display effect can be improved, and the display uniformity can be enhanced. Furthermore, the design of a circuit structure is also simplified so that the occupied area thereof can be reduced, thereby being conducive to realize a high PPI (pixels per inch) display design.

The pixel driving circuit, the pixel driving method and the display device of the solutions of the present disclosure can be used for realizing pixel compensation. The pixel driving circuit may include a light-emitting component, a driving transistor, a storage capacitor, a compensation capacitor, and first to third control assemblys. The first to third control assemblys may achieve a reset stage, a threshold voltage compensation stage, a mobility compensation stage and a light-emitting display stage of the pixel driving circuit in coordination with signals provided by a first control line, a second control line, a scan line, a data line, a power line and a ground line, and adverse factors such as a threshold voltage Vth and a power voltage (e.g., a voltage provided by the power line) can be eliminated. However, since a driving current may preferentially charge the compensation capacitor at the mobility compensation stage, a compensation voltage at the compensation capacitor can be derived. Thus, at the light-emitting display stage, a current flowing through the driving transistor is irrelevant to the threshold voltage of the driving transistor and the power voltage, but relevant to controllable parameter such as a data voltage provided by the data line and a duration of the mobility compensation stage. According to this solution, a compensation degree may be adjusted by adjusting the duration of the mobility compensation stage. In other words, the pixel driving circuit of this solution serves for compensating a threshold voltage Vth drift of the driving transistor and the carrier mobility, thereby reducing the influence of the threshold voltage and a leakage current on the driving current, improving the display effect and enhancing the display uniformity.

Embodiment 2

Embodiment 2 of the present disclosure further provides a pixel driving method for driving the pixel driving circuit mentioned in any embodiment in embodiment 1. The pixel driving method of embodiment 2 may include a reset stage, a threshold voltage compensation stage, a mobility compensation stage and a light-emitting display stage, which are specifically described below with reference to FIG. 1, FIG. 2 and FIG. 3.

At the reset stage (S110): a first level signal is provided to the first response terminal K11 by the first control line such that the receiving terminal K12 and the output terminal of the first control assembly K1 are switched on. A second level signal is provided to the second response terminal K21 by the scan line such that the ground terminal K22 and the third connection terminal P3 of the second control terminal K2 are switched on, the first connection terminal P1 and the third connection terminal P3 are switched off, the data signal terminal K23 and the first connection terminal P1 are switched on, and the first connection terminal P1 and the second connection terminal P2 are switched on. A third level signal is provided to the third response terminal K31 by the second control line such that the fourth connection terminal P4 and the fifth connection terminal P5 of the third control assembly K3 are switched off, and the fifth connection terminal P5 and the sixth connection terminal P6 are switched on.

At the threshold voltage compensation stage (S120): a fourth level signal is provided to the first response terminal K11 by the first control line such that the receiving terminal K12 and the output terminal of the first control assembly K1 are switched off. A fifth level signal is provided to the second response terminal K21 by the scan line such that the ground terminal K22 and the third connection terminal P3 of the second control terminal K2 are switched on, the first connection terminal P1 and the third connection terminal P3 are switched off, the data signal terminal K23 and the first connection terminal P1 are switched on, and the first connection terminal P1 and the second connection terminal P2 are switched on. A sixth level signal is provided to the third response terminal K31 by the second control line such that the fourth connection terminal P4 and the fifth connection terminal P5 of the third control assembly K3 are switched off, and the fifth connection terminal P5 and the sixth connection terminal P6 are switched on.

At the mobility compensation stage (S130): a seventh level signal is provided to the first response terminal K11 by the first control line such that the receiving terminal K12 and the output terminal of the first control assembly K1 are switched on. An eighth level signal is provided to the second response terminal K21 by the scan line such that the ground terminal K22 and the third connection terminal P3 of the second control terminal K2 are switched off, the first connection terminal P1 and the third connection terminal P3 are switched on, the data signal terminal K23 and the first connection terminal P1 are switched off, and the first connection terminal P1 and the second connection terminal P2 are switched off. A ninth level signal is provided to the third response terminal K31 by the second control line such that the fourth connection terminal P4 and the fifth connection terminal P5 of the third control assembly K3 are switched on, and the fifth connection terminal P5 and the sixth connection terminal P6 are switched off.

At the light-emitting display stage (S140): a tenth level signal is provided to the first response terminal K11 by the first control line such that the receiving terminal K12 and the output terminal of the first control assembly K1 are switched on. An eleventh level signal is provided to the second response terminal K21 by the scan line such that the ground terminal K22 and the third connection terminal P3 of the second control terminal K2 are switched off, the first connection terminal P1 and the third connection terminal P3 are switched on, the data signal terminal K23 and the first connection terminal P1 are switched off, and the first connection terminal P1 and the second connection terminal P2 are switched off. A twelfth level signal is provided to the third response terminal K31 by the second control line such that the fourth connection terminal P4 and the fifth connection terminal P5 of the third control assembly K3 are switched off, and the fifth connection terminal P5 and the sixth connection terminal P6 are switched on.

The pixel driving method corresponding to the pixel driving circuit in FIG. 1 is described in detail below with reference to the working timing diagram of the pixel driving circuit shown in FIG. 2.

Figure 2:
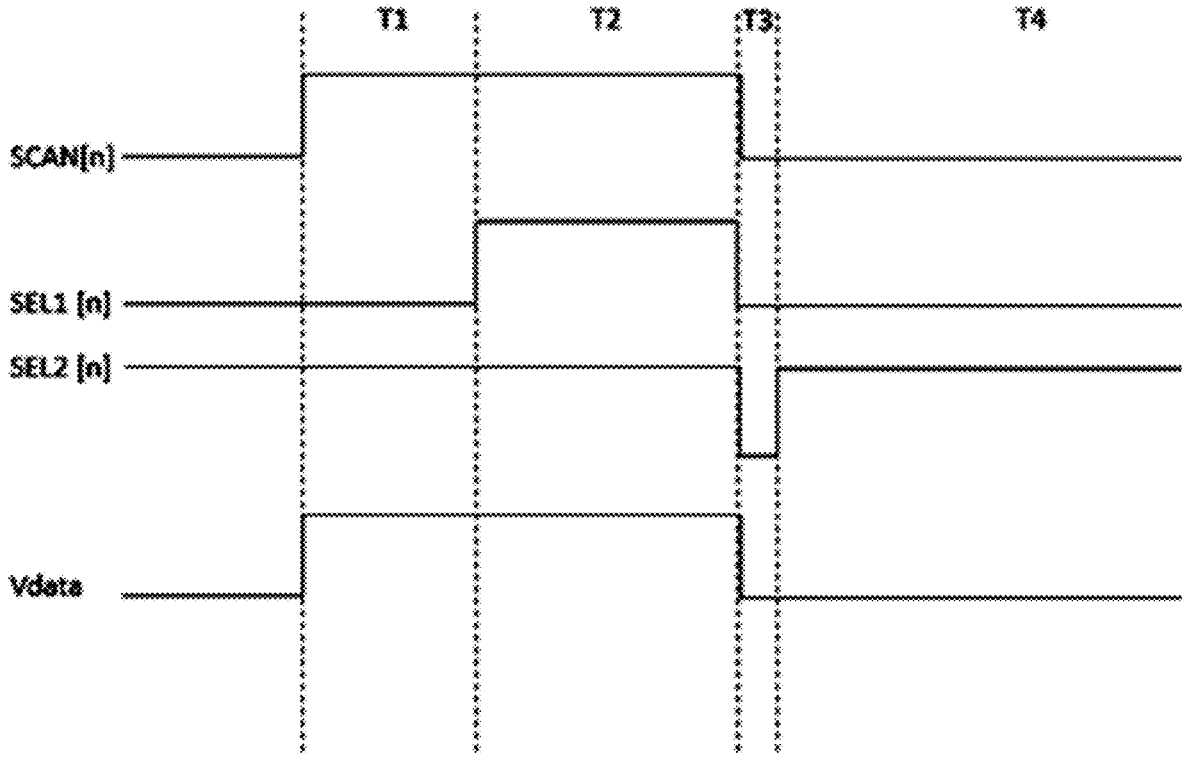
FIG. 2 shows a schematic diagram of timing of a pixel driving method according to embodiment 2 of the present disclosure.

The working timing diagram of the pixel driving circuit shown in FIG. 2 depicts level stages of a first control signal SEL1[n] received by the first response terminal K11, a scanning signal Scan[n] received by the second response terminal K21, a second control signal SEL2[n] received by the third response terminal K31, and a data signal Vdata received by the data signal terminal K23 at the reset stage T1, the threshold voltage compensation stage T2, the mobility compensation stage T3 and the light-emitting display stage T4.

At the reset stage T1: a low-level signal is provided by the first control line to the first response terminal K11 such that the first transistor M1 is switched on; a high-level signal is provided by the scan line to the second response terminal K21 such that the second transistor M2 is switched on, the third transistor M3 is switched off, the fourth transistor M4 is switched on, and the fifth transistor M5 is switched on; and a high-level signal is provided by the second control line to the third response terminal K31 such that the sixth transistor M6 is switched off and the seventh transistor M7 is switched on.

At the reset stage T1, the storage capacitor C1 and the compensation capacitor C2 are mainly initialized, and the influence of charge of a previous frame is eliminated. At this time, the level signals provided by the scan line and the second control line are both high levels and the signal provided by the first control line is a low level, and therefore, the first transistor M1, the second transistor M2, the fourth transistor M4, the fifth transistor M5 and the seventh transistor M7 are switched on, while the third transistor M3 and the sixth transistor M6 are switched off. The voltage $V_S$ at the first terminal (which may also be construed as the point S) and the voltage $V_{C1}$ of the storage capacitor C1 are charged to the power voltage $V_{DD}$ provided by the power line, i.e., $V_S=V_{C1}=V_{DD}$. Two terminals of the compensation capacitor C2 are short-circuited by the fifth transistor M5 to empty the charge. Correspondingly, at the reset stage T1, the data voltage provided by the data line is a high-level signal.

At the threshold voltage compensation stage T2, a high-level signal is provided by the first control line to the first response terminal K11 such that the first transistor M1 is switched off; a high-level signal is provided by the scan line to the second response terminal K21 such that the second transistor M2 is switched on, the third transistor M3 is switched off, the fourth transistor M4 is switched on, and the fifth transistor M5 is switched on; and a high-level signal is provided by the second control line to the third response terminal K31 such that the sixth transistor M6 is switched off and the seventh transistor M7 is switched on. In other words, the threshold voltage $V_{TH}$ of the driving transistor DT is compensated at this stage. At the threshold voltage compensation stage T2 of the driving transistor DT, the signals provided by the first control line, the second control line and the scan line each are high-level signals, and therefore, the second transistor M2, the fourth transistor M4, the fifth transistor M5 and the seventh transistor M7 are switched on, while the first transistor M1, the third transistor M3 and the sixth transistor M6 are switched off. Since the first transistor M1 is switched off and the storage capacitor C1 is connected to the ground, the charge at the point S is gradually released until $V_S=V_{DATA}-V_{TH}$ reaching a stable state, $V_{C1}=V_S=V_{DATA}-V_{TH}$. At this stage, $V_{TH}$ is written in the storage capacitor C1, and two terminals of the compensation capacitor C2 are short-circuited by the fifth transistor M5. It should be understood that $V_{DATA}$ is the data voltage provided by the data line.

At the mobility compensation stage T3, a high-level signal is provided by the first control line to the first response terminal K11 such that the first transistor M1 is switched on; a low-level signal is provided by the scan line to the second response terminal K21 such that the second transistor M2 is switched off, the third transistor M3 is switched on, the fourth transistor M4 is switched off, and the fifth transistor M5 is switched off; and a low-level signal is provided by the second control line to the third response terminal K31 such that the sixth transistor M6 is switched on and the seventh transistor M7 is switched off. In other words, this stage is the carrier mobility compensation stage of the driving transistor. At the mobility compensation stage T3, the signals provided by the first control line, the second control line and the scan line each are low-level signals, and therefore, the second transistor M2, the fourth transistor M4, the fifth transistor M5 and the seventh transistor M7 are switched off, while the first transistor M1, the third transistor M3 and the sixth transistor M6 are switched on. At this time, given the voltage of the point S $V_S=V_{DD}$ and the voltage of the storage capacitor C1 $V_{C1}=V_{DATA}-V_{TH}$, the voltage of the point G is: $V_G=V_{TH}-V_{DATA}+V_{DD}$. The current flowing through the driving transistor DT may be expressed as:

$$I_{OLED}=\frac{1}{2}\times\mu\times\frac{W}{L}\times C_{GI}\times(V_{GS}-V_{TH})^2=\frac{1}{2}\times\mu\times\frac{W}{L}\times C_{GI}\times(V_{TH}-V_{DATA}+V_{DD}-V_{DD}-V_{TH})^2=\frac{1}{2}\times\mu\times\frac{W}{L}\times C_{GI}\times(V_{DATA})^2$$

It should be understood that in the above formula, μ represents the carrier mobility of the driving transistor DT, W represents a channel width of the driving transistor DT, L represents a channel length of the driving transistor DT, CGI represents the gate capacitance of the driving transistor DT, and $V_{GS}$ represents a difference between the voltage $V_G$ at the point G and the voltage $V_S$ at the point S.

Furthermore, as can be derived from the above expression formula, $I_{OLED}$ is irrelevant to the threshold voltage $V_{TH}$ of the driving transistor DT and the power voltage $V_{DD}$ provided by the power line, but the change of the carrier mobility μ may still affect the driving current.

When the second control line is switched to a low level, the sixth transistor M6 is switched on and the point G and the point D are connected by the sixth transistor M6. Thus, the driving current may preferentially charge the compensation capacitor C2. Given a charging time t (the duration of the mobility compensation stage, or referring to the width of T3 in the figure), the compensation voltage may be derived according to a capacitor charging model as $$V_\mu=I_{OLED}\times t\div C2.$$

Thus, it can be derived that $V_\mu$ is in direct proportion to $I_{OLED}$. That is, smaller carrier mobility μ corresponds to lower $V_\mu$.

At the light-emitting display stage, a low-level signal is provided by the first control line to the first response terminal K11 such that the first transistor M1 is switched on; a low-level signal is provided by the scan line to the second response terminal K21 such that the second transistor M2 is switched off, the third transistor M3 is switched on, the fourth transistor M4 is switched off, and the fifth transistor M5 is switched off; and a high-level signal is provided by the second control line to the third response terminal K31 such that the sixth transistor M6 is switched off and the seventh transistor M7 is switched on. At this stage, the current flowing through the driving transistor DT may be expressed as:

$$I_{OLED} = \frac{1}{2} \times \mu \times \frac{W}{L} \times C_{GI} \times (V_{DATA} - V_{\mu})^2.$$

Thus, when the carrier mobility changes, there is corresponding $V_{\mu}$ for compensating the driving current. The influence of the carrier mobility μ on the driving current is reduced, thereby improving the display effect of the OLED light-emitting component.

As a whole, at the four stages, the power line is configured to provide a high-level direct current signal. The first level signal, the seventh level signal and the tenth level signal provided by the first control line are all low-level signals. The fourth level signal provided by the first control line is a high-level signal. The second level signal and the fifth level signal provided by the scan line are both high-level signals. The eighth level signal and the eleventh level signal provided by the scan line are both low-level signals. The third level signal, the sixth level signal and the twelfth level signal provided by the second control line are all high-level signals. The ninth level signal provided by the second control line is a low-level signal. Data signals provided by the data line at the reset stage and the threshold voltage compensation stage are high-level signals; and data signals provided by the data line at the mobility compensation stage and the light-emitting display stage are low-level signals.

Furthermore, the pixel driving method of this embodiment further includes adjusting a duration of the pixel driving circuit being at the mobility compensation stage based on display parameter information.

For example, during detection of a product, a display picture of a display panel may be captured by using a product such as a charge coupled device (CCD). The captured display picture is then resolved to obtain display parameter information that may include brightness, tone and the like. Subsequently, when the display parameter information does not meet target information, the duration of the pixel driving circuit being at the mobility compensation stage may be adjusted so that the display picture meets requirements.

Embodiment 3

Figure 4:
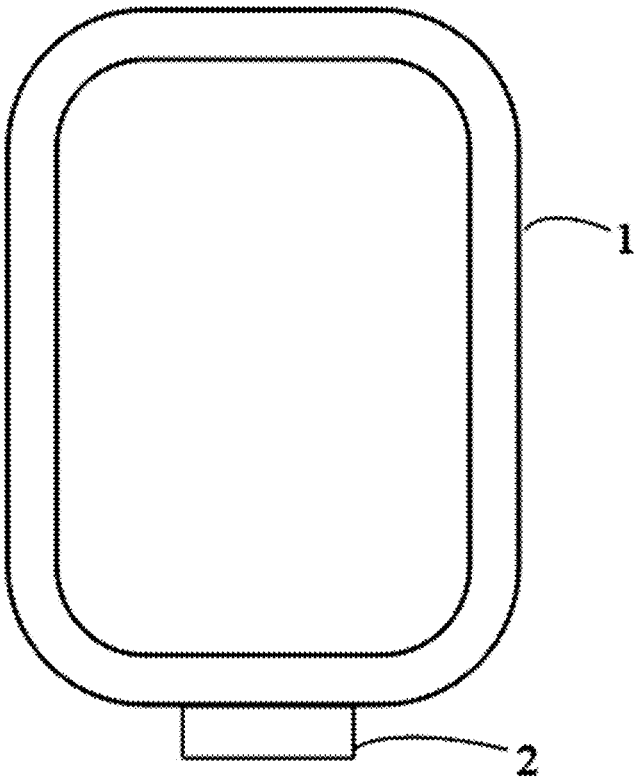
FIG. 4 shows a schematic diagram of a display device according to embodiment 3 of the present disclosure.

Embodiment 3 provides a display device, which may be an OLED display device. As shown in FIG. 4, the display device may include a display panel 1 and a controller 2, wherein the display panel 1 has the pixel driving circuit of any implementation solution in embodiment 1, and the controller 2 is configured to carry out the pixel driving method of any implementation solution in embodiment 2.

The display device of the embodiment of the present disclosure may be an active-matrix organic light-emitting diode (AMOLED) display which has many advantages such as slim body, power saving, bright color and high picture quality and has been widely used. The AMOLED display gradually plays a dominant role in the field of flat panel display, such as an OLED television, a mobile phone, a notebook computer.

In the present description, the description with reference to the term "some embodiments", "exemplarily", "in some alternative embodiments" or the like means that a specific feature, structure, material or characteristic described in combination with the embodiment(s) or example(s) are included in at least one embodiment or example of the present disclosure. In the present description, the schematic representation of the above terms is not necessarily directed to the same embodiment or example. Furthermore, the specific features, structures, materials or characteristics described may be combined in any one or more of embodiments or examples in a suitable manner. In addition, a person skilled in the art may combine different embodiments or examples described herein and features of different embodiments or examples without any contradiction.

Although the embodiments of the present disclosure have been illustrated and described, it may be understood that the foregoing embodiments are exemplary and cannot be construed as limitations to the present disclosure. A person of ordinary skill in the art can make changes, modifications, replacements and variations to the foregoing embodiments within the scope of the present disclosure. Therefore, any change or modification made according to the claims and the description of the present disclosure should fall within the scope covered by the present disclosure.

What is claimed is:

1. A pixel driving circuit, comprising:

a light-emitting component;

a driving transistor having a control terminal connected to a point G, a first terminal connected to a point S, and a second terminal connected to a point D;

a storage capacitor;

a first control assembly has a first response terminal connected to a first control line, a receiving terminal connected to a power line, and an output terminal connected to the point S;

wherein the first response terminal is configured to control an on-off state between the receiving terminal and the output terminal in response to a level signal provided by the first control line;

a second control assembly has a second response terminal connected to a scan line, a ground terminal connected to a ground line, a data signal terminal connected to a data line, a first connection terminal connected to the point G, a second connection terminal connected to a point Q, and a third connection terminal connected to a first terminal of the storage capacitor; wherein the second response terminal is configured to control on-off states between the ground terminal, the data signal terminal, the first connection terminal, the second connection terminal and the third connection terminal in response to level signals provided by the scan line, wherein a second terminal of the storage capacitor is connected to the point S;

a third control assembly has a third response terminal connected to a second control line, a fourth connection terminal connected to the point Q, a fifth connection terminal connected to the point D, and a sixth connection terminal connected to a positive electrode of the light-emitting component, wherein the third response terminal is configured to control on-off states between the fourth connection terminal, the fifth connection terminal and the sixth connection terminal in response to level signals provided by the second control line, wherein a negative electrode of the light-emitting component is connected to the ground line; and a compensation capacitor having a first terminal connected to the point G, and a second terminal connected to the point Q.

2. The pixel driving circuit according to claim 1, wherein the first control assembly further has a first transistor having a control terminal connected to the first response terminal, a first terminal connected to the receiving terminal, and a second terminal connected to the output terminal.

3. The pixel driving circuit according to claim 2, wherein the first transistor and the driving transistor are both P-type transistors.

4. The pixel driving circuit according to claim 1, wherein the second control assembly further has a second transistor, a third transistor, a fourth transistor and a fifth transistor, wherein control terminals of the second transistor, the third transistor, the fourth transistor and the fifth transistor each are connected to the second response terminal;

wherein the second transistor has a first terminal connected to the ground terminal and a second terminal connected to the third connection terminal;

wherein the third transistor has a first terminal connected to the first connection terminal and a second terminal connected to the third connection terminal;

wherein the fourth transistor has a first terminal connected to the data signal terminal and a second terminal connected to the first connection terminal;

wherein the fifth transistor has a first terminal connected to the first connection terminal and a second terminal connected to the second connection terminal;

wherein the second transistor, the fourth transistor and the fifth transistor each are first-type transistors; the third transistor is a second-type transistor; and one of the first-type transistor and the second-type transistor is a P-type transistor, and another of the first-type transistor and the second-type transistor is an N-type transistor.

5. The pixel driving circuit according to claim 4, wherein the second transistor, the fourth transistor and the fifth transistor each are N-type transistors, and the third transistor and the driving transistor are both P-type transistors.

6. The pixel driving circuit according to claim 1, wherein the third control assembly further comprises a sixth transistor and a seventh transistor, wherein control terminals of the sixth transistor and the seventh transistor are both connected to the third response terminal;

wherein the sixth transistor has a first terminal connected to the fourth connection terminal and a second terminal connected to the fifth connection terminal;

wherein the seventh transistor has a first terminal connected to the fifth connection terminal and a second terminal connected to the sixth connection terminal; and one of the sixth transistor and the seventh transistor is a P-type transistor, and another of the sixth transistor and the seventh transistor is an N-type transistor.

7. The pixel driving circuit according to claim 6, wherein the sixth transistor and the driving transistor are both P-type transistors, and the seventh transistor is an N-type transistor.

8. A pixel driving method for driving a pixel driving circuit, wherein pixel driving circuit comprises:

a light-emitting component;

a driving transistor having a control terminal connected to a point G, a first terminal connected to a point S, and a second terminal connected to a point D;

a storage capacitor;

a first control assembly has a first response terminal connected to a first control line, a receiving terminal connected to a power line, and an output terminal connected to the point S; wherein the first response terminal is configured to control an on-off state between the receiving terminal and the output terminal in response to a level signal provided by the first control line;

a second control assembly has a second response terminal connected to a scan line, a ground terminal connected to a ground line, a data signal terminal connected to a data line, a first connection terminal connected to the point G, a second connection terminal connected to a point Q, and a third connection terminal connected to a first terminal of the storage capacitor; wherein the second response terminal is configured to control on-off states between the ground terminal, the data signal terminal, the first connection terminal, the second connection terminal and the third connection terminal in response to level signals provided by the scan line, wherein a second terminal of the storage capacitor is connected to the point S;

a third control assembly has a third response terminal connected to a second control line, a fourth connection terminal connected to the point Q, a fifth connection terminal connected to the point D, and a sixth connection terminal connected to a positive electrode of the light-emitting component, wherein the third response terminal is configured to control on-off states between the fourth connection terminal, the fifth connection terminal and the sixth connection terminal in response to level signals provided by the second control line, wherein a negative electrode of the light-emitting component is connected to the ground line; and a compensation capacitor having a first terminal connected to the point G, and a second terminal connected to the point Q;

wherein the pixel driving method comprises: a reset stage, a threshold voltage compensation stage, a mobility compensation stage and a light-emitting display stage, wherein at the reset stage: providing a first level signal to the first response terminal by the first control line such that the receiving terminal and the output terminal of the first control assembly are switched on; providing a second level signal to the second response terminal by the scan line such that the ground terminal and the third connection terminal of the second control terminal are switched on, the first connection terminal and the third connection terminal are switched off, the data signal terminal and the first connection terminal are switched on, and the first connection terminal and the second connection terminal are switched on; and providing a third level signal to the third response terminal by the second control line such that the fourth connection terminal and the fifth connection terminal of the third control assembly are switched off, and the fifth connection terminal and the sixth connection terminal are switched on;

at the threshold voltage compensation stage: providing a fourth level signal to the first response terminal by the first control line such that the receiving terminal and the output terminal of the first control assembly are switched off; providing a fifth level signal to the second response terminal by the scan line such that the ground terminal and the third connection terminal of the second control terminal are switched on, the first connection terminal and the third connection terminal are switched off, the data signal terminal and the first connection terminal are switched on, and the first connection terminal and the second connection terminal are switched on; and providing a sixth level signal to the third response terminal by the second control line such that the fourth connection terminal and the fifth connection terminal of the third control assembly are switched off, and the fifth connection terminal and the sixth connection terminal are switched on;

at the mobility compensation stage: providing a seventh level signal to the first response terminal by the first control line such that the receiving terminal and the output terminal of the first control assembly are switched on; providing an eighth level signal to the second response terminal by the scan line such that the ground terminal and the third connection terminal of the second control terminal are switched off, the first connection terminal and the third connection terminal are switched on, the data signal terminal and the first connection terminal are switched off, and the first connection terminal and the second connection terminal are switched off; and providing a ninth level signal to the third response terminal by the second control line such that the fourth connection terminal and the fifth connection terminal of the third control assembly are switched on, and the fifth connection terminal and the sixth connection terminal are switched off; and at the light-emitting display stage: providing a tenth level signal to the first response terminal by the first control line such that the receiving terminal and the output terminal of the first control assembly are switched on; providing an eleventh level signal to the second response terminal by the scan line such that the ground terminal and the third connection terminal of the second control terminal are switched off, the first connection terminal and the third connection terminal are switched on, the data signal terminal and the first connection terminal are switched off, and the first connection terminal and the second connection terminal are switched off; and providing a twelfth level signal to the third response terminal by the second control line such that the fourth connection terminal and the fifth connection terminal of the third control assembly are switched off, and the fifth connection terminal and the sixth connection terminal are switched on.

9. The pixel driving method according to claim 8, further comprising:

adjusting a duration of the pixel driving circuit being at the mobility compensation stage based on display parameter information.

10. The pixel driving method according to claim 9, wherein the power line is configured to provide a high-level direct current signal, wherein the first level signal, the seventh level signal and the tenth level signal provided by the first control line each are low-level signals; the fourth level signal provided by the first control line is a high-level signal, wherein the second level signal and the fifth level signal provided by the scan line are both high-level signals, wherein the eighth level signal and the eleventh level signal provided by the scan line are both low-level signals, wherein the third level signal, the sixth level signal and the twelfth level signal provided by the second control line each are high-level signals, wherein the ninth level signal provided by the second control line is a low-level signal, wherein data signals provided by the data line at the reset stage and the threshold voltage compensation stage are high-level signals; and data signals provided by the data line at the mobility compensation stage and the light-emitting display stage are low-level signals.

11. The pixel driving method according to claim 8, wherein the power line is configured to provide a high-level direct current signal, wherein the first level signal, the seventh level signal and the tenth level signal provided by the first control line each are low-level signals; the fourth level signal provided by the first control line is a high-level signal, wherein the second level signal and the fifth level signal provided by the scan line are both high-level signals, wherein the eighth level signal and the eleventh level signal provided by the scan line are both low-level signals, wherein the third level signal, the sixth level signal and the twelfth level signal provided by the second control line each are high-level signals, wherein the ninth level signal provided by the second control line is a low-level signal, wherein data signals provided by the data line at the reset stage and the threshold voltage compensation stage are high-level signals; and data signals provided by the data line at the mobility compensation stage and the light-emitting display stage are low-level signals.

12. A display device comprising:

a display panel and a controller;

wherein the display panel has a pixel driving circuit;

wherein pixel driving circuit comprises:

a light-emitting component;

a driving transistor having a control terminal connected to a point G, a first terminal connected to a point S, and a second terminal connected to a point D;

a storage capacitor;

a first control assembly has a first response terminal connected to a first control line, a receiving terminal connected to a power line, and an output terminal connected to the point S; wherein the first response terminal is configured to control an on-off state between the receiving terminal and the output terminal in response to a level signal provided by the first control line;

a second control assembly has a second response terminal connected to a scan line, a ground terminal connected to a ground line, a data signal terminal connected to a data line, a first connection terminal connected to the point G, a second connection terminal connected to a point Q, and a third connection terminal connected to a first terminal of the storage capacitor; wherein the second response terminal is configured to control on-off states between the ground terminal, the data signal terminal, the first connection terminal, the second connection terminal and the third connection terminal in response to level signals provided by the scan line, wherein a second terminal of the storage capacitor is connected to the point S;

a third control assembly has a third response terminal connected to a second control line, a fourth connection terminal connected to the point Q, a fifth connection terminal connected to the point D, and a sixth connection terminal connected to a positive electrode of the light-emitting component, wherein the third response terminal is configured to control on-off states between the fourth connection terminal, the fifth connection terminal and the sixth connection terminal in response to level signals provided by the second control line, wherein a negative electrode of the light-emitting component is connected to the ground line; and a compensation capacitor having a first terminal connected to the point G, and a second terminal connected to the point Q;

wherein the controller is configured to carry out a pixel driving method for driving the pixel driving circuit, wherein the pixel driving method comprises: a reset stage, a threshold voltage compensation stage, a mobility compensation stage and a light-emitting display stage;

wherein at the reset stage: providing a first level signal to the first response terminal by the first control line such that the receiving terminal and the output terminal of the first control assembly are switched on; providing a second level signal to the second response terminal by the scan line such that the ground terminal and the third connection terminal of the second control terminal are switched on, the first connection terminal and the third connection terminal are switched off, the data signal terminal and the first connection terminal are switched on, and the first connection terminal and the second connection terminal are switched on; and providing a third level signal to the third response terminal by the second control line such that the fourth connection terminal and the fifth connection terminal of the third control assembly are switched off, and the fifth connection terminal and the sixth connection terminal are switched on;

at the threshold voltage compensation stage: providing a fourth level signal to the first response terminal by the first control line such that the receiving terminal and the output terminal of the first control assembly are switched off; providing a fifth level signal to the second response terminal by the scan line such that the ground terminal and the third connection terminal of the second control terminal are switched on, the first connection terminal and the third connection terminal are switched off, the data signal terminal and the first connection terminal are switched on, and the first connection terminal and the second connection terminal are switched on; and providing a sixth level signal to the third response terminal by the second control line such that the fourth connection terminal and the fifth connection terminal of the third control assembly are switched off, and the fifth connection terminal and the sixth connection terminal are switched on;

at the mobility compensation stage: providing a seventh level signal to the first response terminal by the first control line such that the receiving terminal and the output terminal of the first control assembly are switched on; providing an eighth level signal to the second response terminal by the scan line such that the ground terminal and the third connection terminal of the second control terminal are switched off, the first connection terminal and the third connection terminal are switched on, the data signal terminal and the first connection terminal are switched off, and the first connection terminal and the second connection terminal are switched off; and providing a ninth level signal to the third response terminal by the second control line such that the fourth connection terminal and the fifth connection terminal of the third control assembly are switched on, and the fifth connection terminal and the sixth connection terminal are switched off; and at the light-emitting display stage: providing a tenth level signal to the first response terminal by the first control line such that the receiving terminal and the output terminal of the first control assembly are switched on; providing an eleventh level signal to the second response terminal by the scan line such that the ground terminal and the third connection terminal of the second control terminal are switched off, the first connection terminal and the third connection terminal are switched on, the data signal terminal and the first connection terminal are switched off, and the first connection terminal and the second connection terminal are switched off; and providing a twelfth level signal to the third response terminal by the second control line such that the fourth connection terminal and the fifth connection terminal of the third control assembly are switched off, and the fifth connection terminal and the sixth connection terminal are switched on.

13. The display device according to claim 12, wherein the first control assembly further has a first transistor having a control terminal connected to the first response terminal, a first terminal connected to the receiving terminal, and a second terminal connected to the output terminal.

14. The display device according to claim 13, wherein the first transistor and the driving transistor are both P-type transistors.

15. The display device according to claim 12, wherein the second control assembly further has a second transistor, a third transistor, a fourth transistor and a fifth transistor, wherein control terminals of the second transistor, the third transistor, the fourth transistor and the fifth transistor each are connected to the second response terminal;

wherein the second transistor has a first terminal connected to the ground terminal and a second terminal connected to the third connection terminal;

wherein the third transistor has a first terminal connected to the first connection terminal and a second terminal connected to the third connection terminal;

wherein the fourth transistor has a first terminal connected to the data signal terminal and a second terminal connected to the first connection terminal;

wherein the fifth transistor has a first terminal connected to the first connection terminal and a second terminal connected to the second connection terminal;

wherein the second transistor, the fourth transistor and the fifth transistor each are first-type transistors; the third transistor is a second-type transistor; and one of the first-type transistor and the second-type transistor is a P-type transistor, and another of the first-type transistor and the second-type transistor is an N-type transistor.

16. The display device according to claim 15, wherein the second transistor, the fourth transistor and the fifth transistor each are N-type transistors, and the third transistor and the driving transistor are both P-type transistors.

17. The display device according to claim 12, wherein the third control assembly further comprises a sixth transistor and a seventh transistor, wherein control terminals of the sixth transistor and the seventh transistor are both connected to the third response terminal;

wherein the sixth transistor has a first terminal connected to the fourth connection terminal and a second terminal connected to the fifth connection terminal;

wherein the seventh transistor has a first terminal connected to the fifth connection terminal and a second terminal connected to the sixth connection terminal; and one of the sixth transistor and the seventh transistor is a P-type transistor, and another of the sixth transistor and the seventh transistor is an N-type transistor.

18. The display device according to claim 17, wherein the sixth transistor and the driving transistor are both P-type transistors, and the seventh transistor is an N-type transistor.

19. The display device according to claim 18, wherein the pixel driving method comprises:

adjusting a duration of the pixel driving circuit being at the mobility compensation stage based on display parameter information.

* * * * *